US008630561B2

(12) United States Patent
Sugiyama

(10) Patent No.: US 8,630,561 B2
(45) Date of Patent: Jan. 14, 2014

(54) IMAGE FORMING APPARATUS, CHARGING APPARATUS AND CLEANING METHOD OF CHARGING APPARATUS

(75) Inventor: Yoshihiko Sugiyama, Saitama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 327 days.

(21) Appl. No.: 13/097,926

(22) Filed: Apr. 29, 2011

(65) Prior Publication Data

US 2011/0274459 A1 Nov. 10, 2011

Related U.S. Application Data

(60) Provisional application No. 61/332,689, filed on May 7, 2010.

(51) Int. Cl.
*G03G 15/02* (2006.01)

(52) U.S. Cl.
USPC ..... 399/100

(58) Field of Classification Search
USPC ..... 399/100
See application file for complete search history.

(56) References Cited

U.S. PATENT DOCUMENTS

| | | | | |
|---|---|---|---|---|
| 3,842,273 | A * | 10/1974 | Van Buskirk | 399/100 |
| 3,965,400 | A * | 6/1976 | Tolliver | 399/100 |
| 5,532,798 | A | 7/1996 | Nakagami et al. | |
| 5,687,054 | A | 11/1997 | Takada et al. | |
| 7,428,392 | B2 | 9/2008 | Yamashita | |
| 2005/0207778 | A1 * | 9/2005 | Yamashita | 399/100 |
| 2006/0127123 | A1 * | 6/2006 | Yamashita | 399/100 |
| 2008/0199206 | A1 * | 8/2008 | Zona et al. | 399/100 |
| 2010/0296835 | A1 * | 11/2010 | Itabashi | 399/100 |

* cited by examiner

*Primary Examiner* — G. M. Hyder
(74) *Attorney, Agent, or Firm* — Patterson & Sheridan, L.L.P.

(57) ABSTRACT

An image forming apparatus according to an embodiment includes an image carrier which is irradiated with a laser beam to form an electrostatic latent image, and a charging device which is disposed in parallel to the image carrier and includes an electrode that charges an electric charge to the image carrier. The charging device has a cleaning device which includes a container accommodating a cleaning member abutting an end portion of a discharge side of the electrode, moves the container along the longitudinal direction of the electrode, removes foreign matter attached to the electrode by the cleaning member, and accommodates the foreign matter in the container.

17 Claims, 6 Drawing Sheets

32
41
42
43
44
44A
45
46
47
48
49
50
51
52
53
54
55
56
57
58
59
X1
X2

IMAGE FORMING APPARATUS, CHARGING APPARATUS AND CLEANING METHOD OF CHARGING APPARATUS

CROSS-REFERENCE TO RELATED APPLICATION

This application is based upon and claims the priority of U.S. Provisional Application No. 61/332,689, filed on May, 7, 2010, the entire contents of which are incorporated herein by reference.

FIELD

Embodiments described herein below relate to an image forming apparatus that forms an image on a recording medium such as s sheet of paper, and a cleaning method of removing foreign matter such as sheet residuum or toner dust attached to a charging device upon forming an image.

BACKGROUND

Generally, in an electrophotographic recording type of an image forming apparatus, a photoconductive drum is irradiated with a laser beam to form an electrostatic latent image. The photoconductive drum forms a toner image by a developing device and transfers the toner image onto a sheet of paper to obtain an image. Furthermore, the image forming apparatus includes a charging device, thereby uniformly charging an electric charge to an outer peripheral surface of the photoconductive drum by the charging device in an axial direction.

Incidentally, in the image forming apparatus of the related art, foreign matter and the like such as discharge products or toner dust that is attached to a discharge electrode of the charging device, sheet fiber and floating matter floated by the flow of wind in a device body are attached to the charging device. When foreign matter is attached to the charging device, an image noise occurs, which causes a decline in the printing quality.

DETAILED DESCRIPTION

Figure 1:
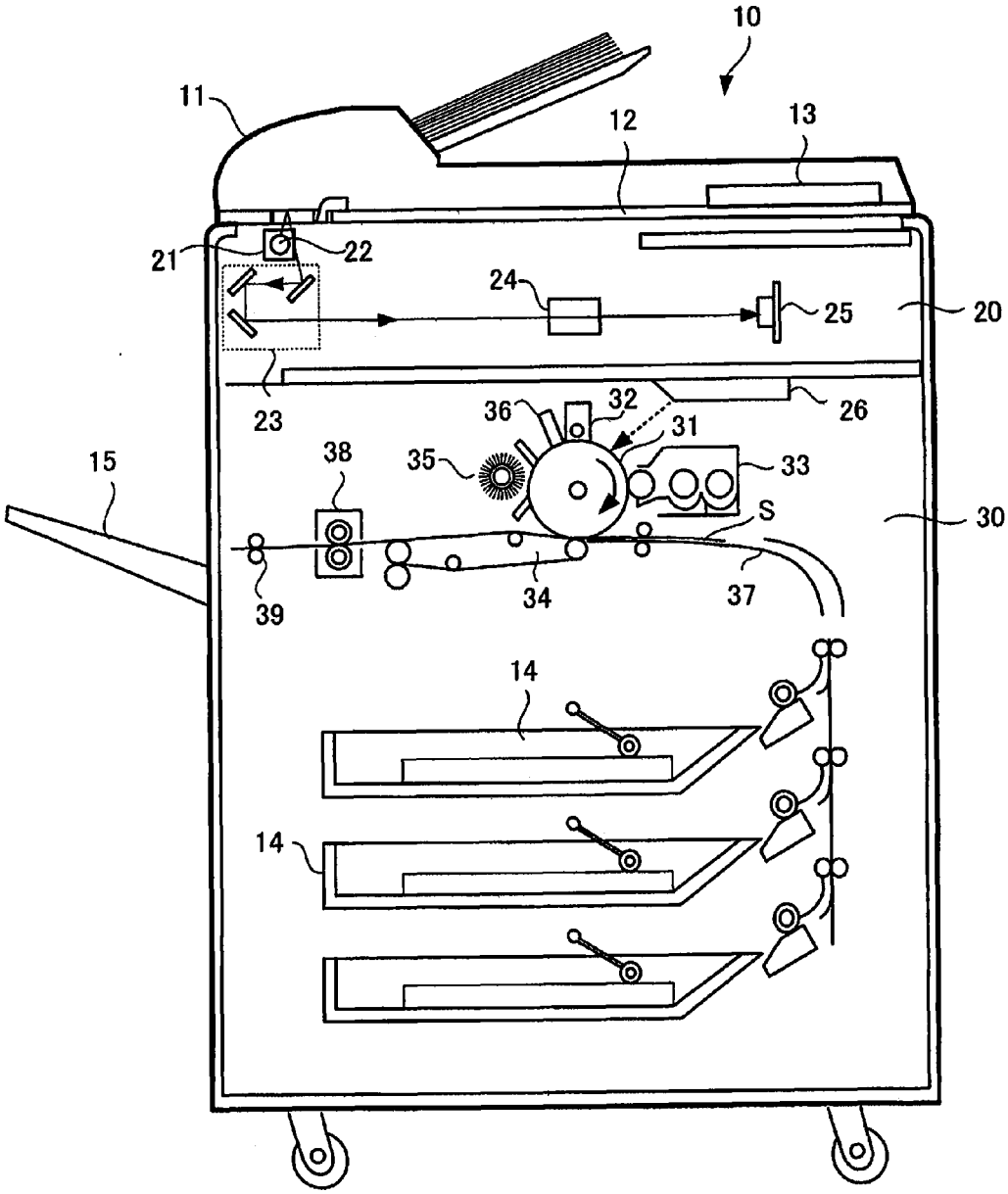
FIG. 1 illustrates a configuration diagram of an image forming apparatus according to an embodiment.

An image forming apparatus according to an embodiment including:

an image carrier which is irradiated with a laser beam to form an electrostatic latent image, a charging device which is disposed in parallel to the image carrier and includes an electrode that charges an electric charge to the image carrier, a cleaning device which includes a container accommodating a first cleaning member abutting an end portion of a discharge side of the electrode, enables the container to move along the longitudinal direction of the electrode, removes foreign matter attached to the electrode by the cleaning member, and accommodates the foreign matter in the container, a developing device that supplies the image carrier with a developer, and a transfer device that transfers a toner image formed on the image carrier by the developing device onto a recording medium.

Hereinafter, an image forming apparatus according to an embodiment will be described with reference to the drawings. Furthermore, the same parts in each drawing will be denoted by the same reference numerals.

FIG. 1 illustrates a configuration diagram of an image forming apparatus according to an embodiment. In FIG. 1, an image forming apparatus 10 is, for example, an MFP (Multi-Function Peripheral) that is a combiner, a printer, a copier or the like. In the following description, the MFP will be described as an example.

On an upper part of the image forming apparatus (MFP) 10, an automatic document feeding device (ADF) 11, a transmitting document table 12, and an operation panel 13 are included. Furthermore, a plurality of sheet feeding devices 14 are provided on a lower part of the MFP 10, and a tray 15 for stacking the sheet is provided on a side surface of the MFP 10.

Furthermore, the MFP 10 includes a scanner unit 20, and a printer unit 30. The scanner unit 20 reads an image of a document, and the printer unit 30 forms an image on a recoding medium such as a sheet of paper based on the read data. In the following description, an example will be described in which the sheet S is used as the recording medium.

The scanner unit 20 includes a carriage 21, an exposure lamp 22, a reflection mirror 23, a lens 24, a CCD (Charge Coupled Device) 25, and a laser unit 26. The scanner unit 20 radiates light from the exposure lamp 22 provided in the carriage 21 to the document from the lower part of the document table 12 so as to scan and read the document transported by the ADF 11 or the document placed on the document table 12. Moreover, the reflected light from the document is put into a CCD 25 via the reflection mirror 23 and the lens 24.

Image information input to the CCD 25 is output as an analog signal. The analog signal is converted to a digital signal and is subjected to an image process, whereby image data is created. The image data is supplied to the laser unit 26, and a laser beam is generated from the laser unit 26 depending on the image data.

Since the printer unit 30 constitutes an image forming unit, the printer unit 30 has a rotatable photoconductive drum 31. The photoconductive drum 31 is an image carrier. In the periphery of the photoconductive drum 31, a charging device 32, a developing device 33, a transfer device 34, a cleaner 35, and a neutralization lamp 36 are included along a rotation direction. The laser beam from the laser unit 26 is radiated to the photoconductive drum 31, and an electrostatic latent image corresponding to the image information of the document is formed on the outer peripheral surface of the photoconductive drum 31.

When the image formation is started, the charging device 32 is discharged in a predetermined discharge position, uniformly charges the electric charge on the outer peripheral surface of the rotating photoconductive drum 31 in the axial direction, and gives the surface of the photoconductive drum 31 (−) electric charge.

Next, a laser beam is radiated from the laser unit 26 to the photoconductive drum 31. The charging surface of the photoconductive drum 31 is scanned and exposed, and the electrostatic latent image relative to the scanning exposure pattern is formed and held on the surface of the photoconductive drum 31.

The developer (for example, toner) is supplied from the developing device 33 onto the outer peripheral surface of the photoconductive drum 31, and the electrostatic latent image is converted to a toner image and is developed. The toner image formed on the outer peripheral surface of the photoconductive drum 31 is electrostatically transferred onto the sheet S by the transfer device 34. The sheet S is transported from the sheet feeding device 14 via a transport path 37.

Foreign matter such as sheet residue remaining on the photoconductive drum 31 is removed by a cleaner 35 disposed in a post-process of the transfer device 34. The neutralization lamp 36 removes a (−) residual electric charge of the outer peripheral surface of the photoconductive drum 31.

Furthermore, the configuration of the printer unit 30 can use another method, for example, a method of using an intermediate transfer belt or the like, without being limited to the example shown. Furthermore, in FIG. 1, the image forming unit is simply shown, when forming the color image, color image forming units such as black, magenta, cyan, yellow or the like are included. Furthermore, the MFP 10 can process the print data, which was input from a PC (Personal Computer) or the like, and can output the print data to the printer unit 30 and can print the print data.

The sheet S, onto which the toner image was transferred by the printer unit 30, is transported to the fixing device 38. The fixing device 38 includes a fixing roller and a pressing roller disposed opposite to each other, and fixes the toner image transferred onto the sheet S to the sheet S by transporting the sheet S between the fixing roller and the pressing roller. The sheet S, in which the toner image is fixed and the image formation is completed, is discharged by a sheet discharging roller 39 to the tray 15.

Figure 2:
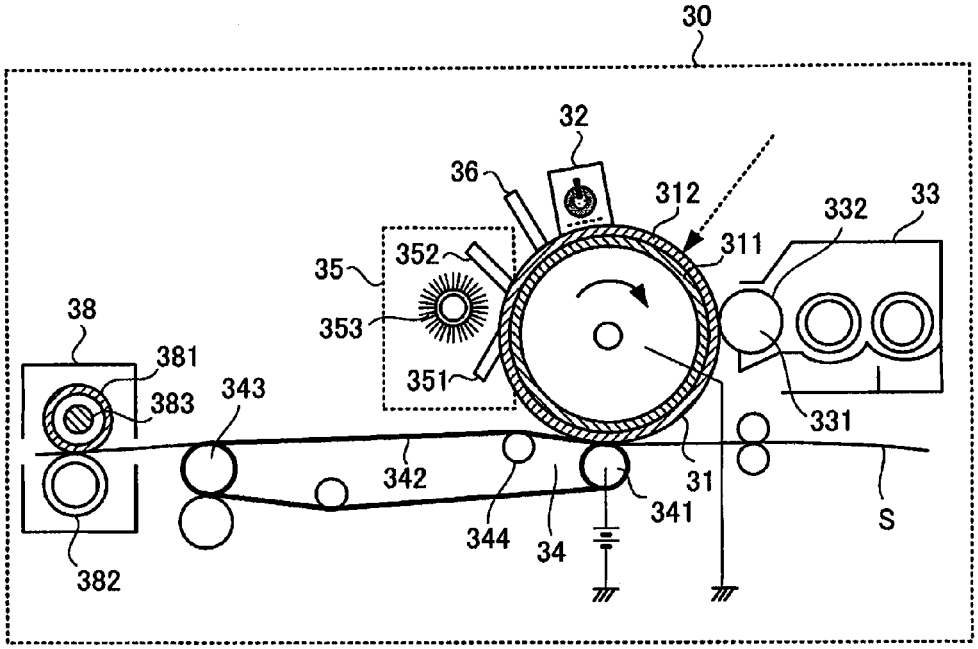
FIG. 2 illustrates an enlarged configuration diagram of an image forming apparatus in an embodiment.

FIG. 2 illustrates an enlarged configuration diagram of a printer unit 30. In FIG. 2, the photoconductive drum 31 includes a metallic base body 311 formed of, for example, a hollow aluminum, and a photoconductive layer 312 formed on the surface of the metallic base body 311. The photoconductive layer 312 includes, for example, an organic photoconductor (OPC). Furthermore, the metallic base body 311 is electrically grounded on a housing portion of the image forming apparatus 10.

The developing device 33 adopts a two component developing method, and includes a magnet roller 331, and a developing sleeve 332 that rotates around the outer periphery of the magnet roller 331. The magnet roller 331 selectively provides the toner moving on the surface of the developing sleeve 332 to the latent image of the surface of the photoconductive drum 31 while magnetically adsorbing the toner.

The transfer device 34 includes a transfer roller 341, a sheet transport belt 342, a driven roller 343 and a peeling device 344. The sheet transport belt 342 is rotated by the transfer roller 341 and the driven roller 343 to transport the sheet S. Furthermore, the toner image is transferred onto the sheet S transported on the sheet transport belt 342 by an electric field to be supplied by the transfer roller 341. The peeling device 344 separates the sheet S with the toner attached thereon from the surface of the photoconductive drum 31.

The cleaner 35 includes, for example, seal materials 351 and 352 or a cylindrical brush 353, and forcibly scrapes off foreign matter such as sheet residue or residual toner attached to the surface of the photoconductive drum 31. The neutralization lamp 36, for example, drops (−) electric charge on the photoconductive drum 31 onto an earth by causing light to touch the whole photoconductive drum 31 (the image forming range) by the LED.

The fixing device 38 includes a fixing roller 381 and a pressing roller 382. The fixing roller 381 has a heater 383 for heating therein, and the fixing roller 381 and the pressing roller 382 are rotated in a mutually contacting state. Moreover, the sheet S passes through a portion between the fixing roller 381 and the pressing roller 382, thereby fixing the toner on the sheet S to the sheet S.

Hereinafter, the charging device 32 according to an embodiment will be described with reference to FIGS. 3 and 4A to 4C. As a discharge electrode of the charging device 32, there is a corona wire or a needle-shaped electrode. In the following description, an example will be described which uses a needle-shaped discharge electrode (needle-shaped electrode). The needle-shaped electrode has a low discharge electric current and can stabilize the discharge, thereby reducing the amount of ozone generated.

In the charging device that uses the needle-shaped electrode, silicon as a discharge product is attached to the periphery of the needle-shaped electrode, and grows as the discharge is repeated, and discharge irregularity occurs according to the growth of silicon. Furthermore, as time passes, toner dust or sheet powder is attached to the electrode and discharge irregularity occurs. When foreign matter such as silicon, toner dust, sheet powder or the like is attached to the needle-shaped electrode, the attachment is a cause of image noise, and thus, the cleaning device is provided in the charging device 32.

Figure 3:
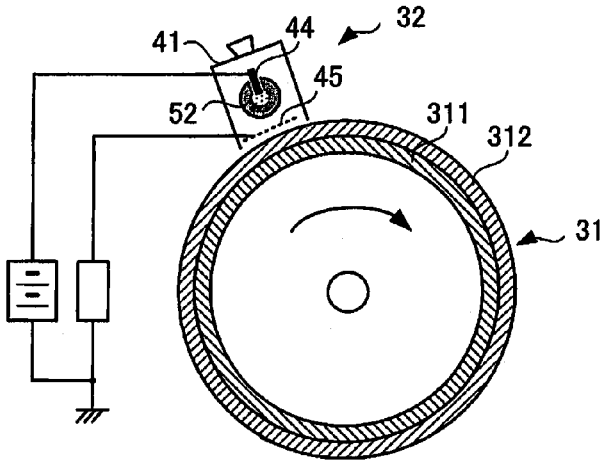
FIG. 3 illustrates an explanatory diagram of the arrangement of a charging device and a photoconductive drum in an embodiment.

FIG. 3 illustrates the arrangement of the charging device 32 and the photoconductive drum 31. The charging device 32 has a metallic shield plate 41 having a U-shaped cross-section, and a needle-shaped electrode 44 which is extended between insulation terminals 42 and 43 (FIG. 4B) provided in both ends of the shield plate 41. When applying a high voltage to the electrode 44, air around the needle-shaped electrode has an electric charge, air is ionized, and the ionized air flows to the photoconductive drum 31 and is electrified. The phenomenon is called corona discharge.

Furthermore, a grid 45 is disposed in an opening portion of the shield plate 41 of the charging device 32. The (−) electric charge is similarly given to the surface of the photoconductive drum 31 by the corona discharge and the grid 45. The grid 45 is used to control the passage of electrically charged particles and cause the charge electric potential to converge to a certain value. The grid 45 is mounted so as not to damage a mesh portion or a fine portion or so that contaminants (fingerprints of a person and the like) are not attached thereto.

Figures 4A, 4B, 4C:
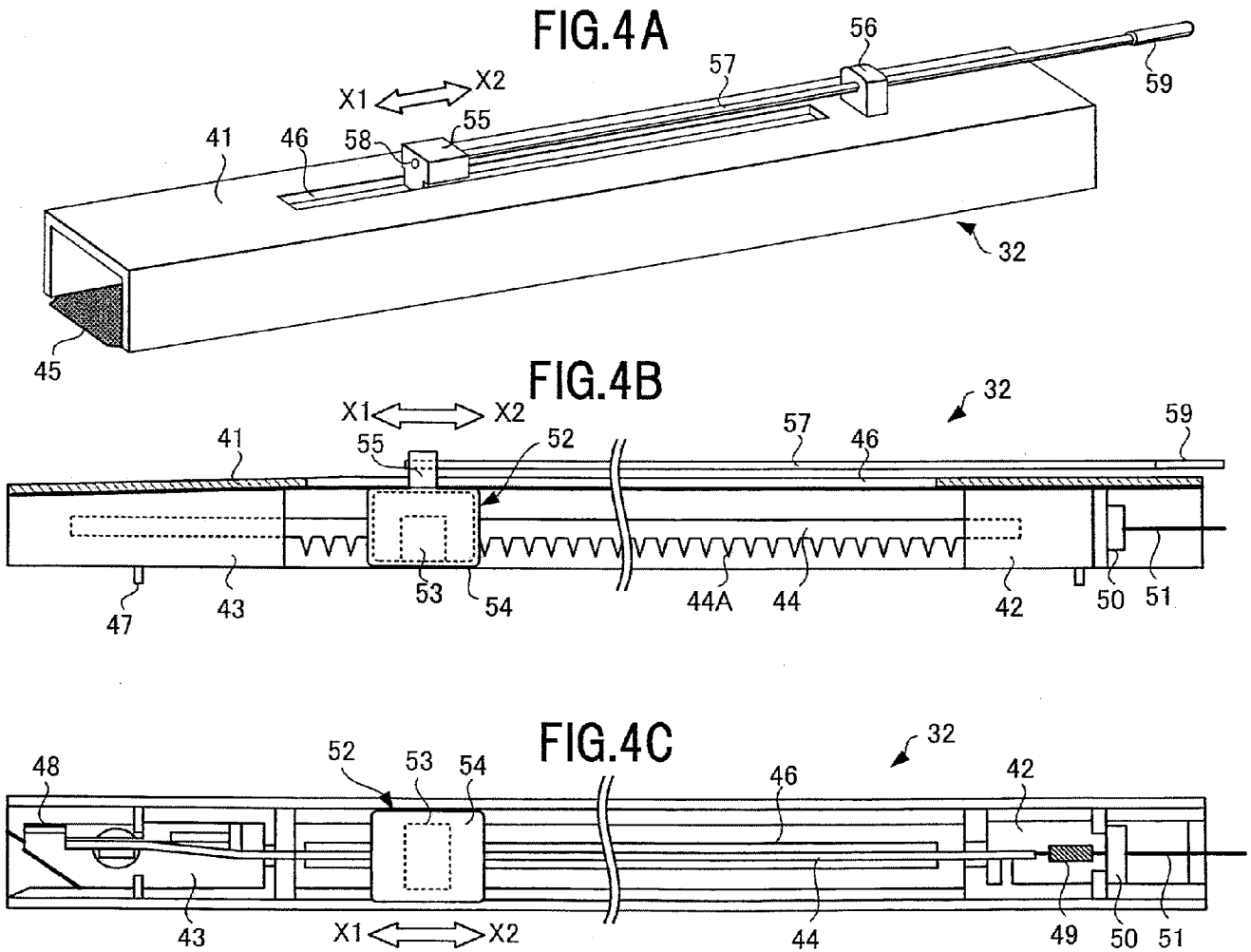
FIG. 4A illustrates a perspective view of a charging device in an embodiment.
FIG. 4B illustrates a side view of a charging device in an embodiment.
FIG. 4C illustrates a bottom view of a charging device in an embodiment.

FIGS. 4A to 4C illustrate configurations of a charging device 32. FIG. 4A illustrates a perspective view of the charging device 32, FIG. 4B illustrates a side view of the charging device 32, and FIG. 4C illustrates a bottom view of the charging device 32. Furthermore, in FIGS. 4B and 4C, the grid 45 is omitted.

As shown in FIGS. 4A to 4C, the charging device 32 has a shield plate 41 having a U-shaped cross-section. The shield plate 41 is disposed so as to face the surface of the photoconductive drum 31 in parallel to an axial direction of the photoconductive drum 31, has an opening at a bottom side thereof, and the grid 45 is provided in the opening. Furthermore, in a ceiling portion of the shield plate 41, a slit 46 is provided in the longitudinal direction.

Insulation terminals 42 and 43 are provided in both ends of the shield plate 41, and both ends of the electrode 44 are supported by the insulation terminals 42 and 43. Furthermore, on the bottom surface of the insulation terminals 42 and 43, a concave portion 47 for attaching the grid 45 is provided (FIG. 4B).

The electrode 44 is formed of an electrically conductive member extended in the axial direction of the photoconductive drum 31, for example, stainless steel, and forms a plurality of charging needles 44A at one side thereof facing the grid 45. The electrode 44, for example, forms the charging needles 44A having a thickness of 0.1 mm and a height of 2 mm at a gap of 2 mm. Furthermore, the electrode 44 is disposed so that a portion between the charging needles 44A and the surface of the photoconductive drum 31 maintains a gap of, for example, 9.2 mm. Furthermore, be desirable that a front end of the charging needle 44A has a curvature (R) equal to or less than 30 μmm.

The electrode 44 is supported by the insulation terminals 42 and 43, and as shown in FIG. 4C, an end of the electrode 44 is connected to an electricity feeding plate 48. Furthermore, the other end of the electrode 44 is connected to a fixing plate 50 via a spring 49. Thus, the electrode 44 is supported on the insulation terminals 42 and 43 in the state in which a tension is applied. The electrode 44 is connected to the electricity feeding portion 51 and is electrically connected to a high voltage generator.

A cleaning device 52 of the charging device 32 includes a cleaning member 53 that cleans the charging needles 44A of the electrode 44, and a container 54 that accommodates the cleaning member 53. The container 54 is movable along the longitudinal direction of the shield plate 41. When the container 54 is moved, the cleaning member 53 scrapes off the foreign matter attached to the plurality of charging needles 44A and accommodates the fallen foreign matter in the container 54.

A guide 55 is provided in the ceiling portion of the container 54, and the guide 55 is adapted to be protruded through the slit 46 of the shield plate 41 (FIG. 4A). Furthermore, a protrusion 56 is provided in the ceiling portion of the shield plate 41. The protrusion 56 faces the guide 55, and a movement rod 57 is mounted through the protrusion 56. A front end 58 of the movement rod 57 is fixed to the guide 55, and other end 59 of the movement rod 57 is operable by a user.

Thus, by pushing or pulling the movement rod 57 by a user operation, the container 54 is moved to arrows X1-X2 along the electrode 44, thereby cleaning the charging needles 44A by the cleaning member 53.

Figure 5:
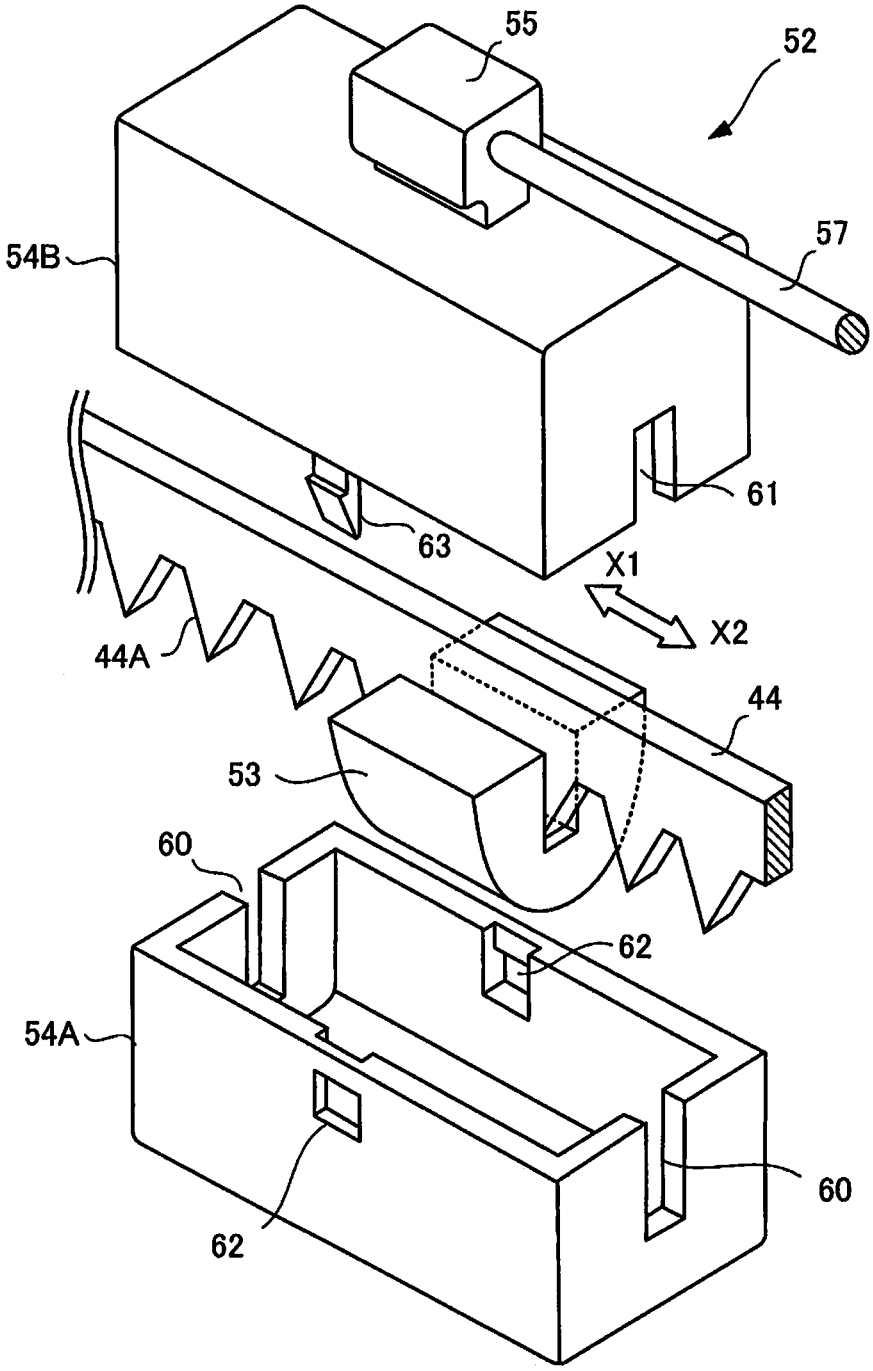
FIG. 5 illustrates an exploded perspective view of a cleaning device of a charging device in an embodiment.

FIG. 5 illustrates an exploded perspective view of the structure of the cleaning member 53 and the container 54 of the cleaning device 52. The container 54 can be separated into a lower holder 54A and an upper holder 54B. The cleaning member 53 is accommodated and fixed in a center portion of the lower holder 54A.

The cleaning member 53 can be attached to and detached from the container 54 and can be exchanged. The cleaning member 53 has a U-shaped cross-section so as to surround the charging needles 44A of the electrode 44. As the cleaning member 53, for example, a material such as polyimide or polyamide represented by Kapton Sheeting™ may be used.

In the end portion of the lower holder 54A in the movement direction, a slit 60 is formed through which the electrode 44 passes. The lower holder 54A has a space that accommodates the foreign matter near both sides of the cleaning member 53, and can accommodate the foreign matter fallen upon cleaning the electrode 44.

The upper holder 54B inserts the guide 55 into the ceiling portion, and fixes the front end of the movement rod 57 to the guide 55. Furthermore, in the end portion of the upper holder 54B in the movement direction, a slit is formed through which the electrode 44 passes. Furthermore, in order to combine and fix the lower holder 54A and the upper holder 54B, for example, a window 62 is formed on the side surface of the lower holder 54A, and a hook 63 is provided in a position that faces the window 62 of the upper holder 54B. If the lower holder 54A and the upper holder 54B are combined with each other so that the hook 63 is fitted into the window 62, the container 54 can be assembled.

Thus, the user causes the movement rod 57 to exit and enter, whereby the container 54 is moved in the axial direction (arrows X1-X2 direction) of the photoconductive drum 31, and the cleaning member 53 is moved while coming into contact with the charging needles 44A of the electrode 44. Foreign matter such as silicon, toner dust or sheet powder attached to the charging needles 44A of the electrode 44 is scrapped off by the cleaning member 53 and can be accommodated in the container 54 (the lower holder 54A).

Furthermore, in regard to the cleaning member 53 of FIG. 5, although an example was described which has a U-shaped structure surrounding the charging needles 44A of the electrode 44, other structures may be adopted.

Figure 6A:
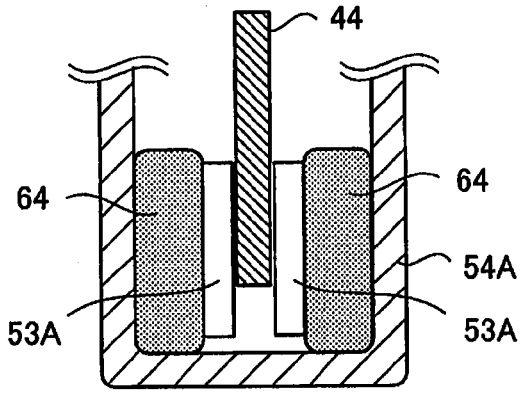
FIGS. 6A to 6D illustrate cross-sectional views of modified examples of a cleaning device in an embodiment.

FIGS. 6A to 6D illustrate explanatory diagrams of modified examples of the cleaning member 53. FIG. 6A is a structure in which the cleaning member 53A such as polyimide (kapton sheet) is interposed between insulating elastic bodies 64 and the charging needles 44A of the electrode 44 are interposed between the cleaning members 53A. The shape of the cleaning member 53A is a plate shape, a circular shape, a shape that is curved toward the electrode 44, or the like, and is constituted by two types or more of the elastic body 64 and the cleansing member 53A.

Figure 6B:
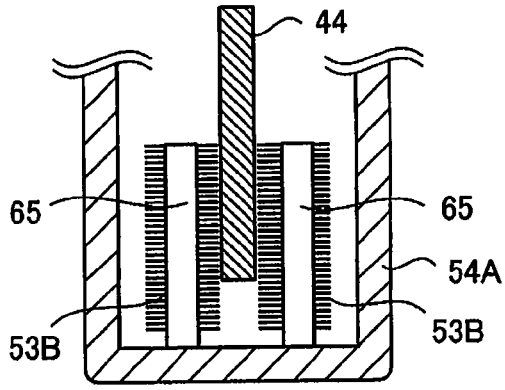

FIG. 6B is a structure in which the electrode 44 is interposed between the metallic elastic bodies 53B (for example, a stainless material). The elastic body 53B has a brush shape and is attached to the rotation shaft 65. Furthermore, the metallic elastic body 53B does not need to be a brush shape but may be a shape of coming into contact with the charging needles 44A of the electrode 44. When the cleaning member 53A of the metallic elastic body is used, be desirable that an average roughness of the surface is selected by a life property of the cleaning device in a range equal to or less than 1.6a.

Figure 6C:
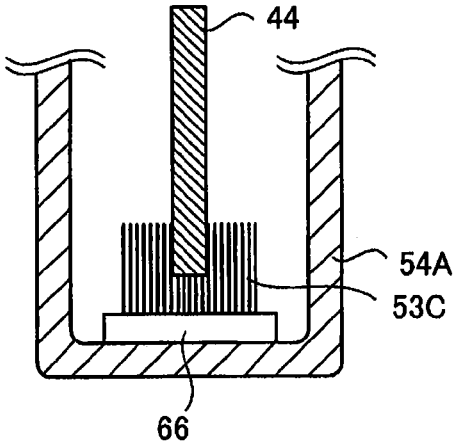
Figure 6D:
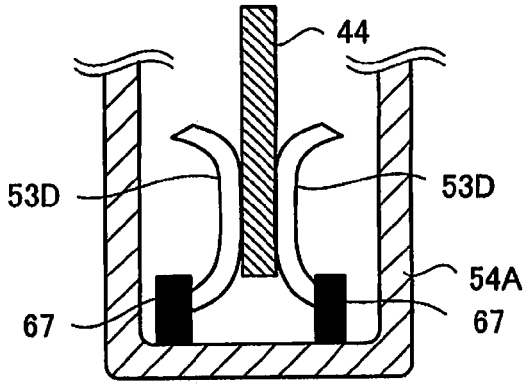

FIG. 6C illustrates an example in which a brush 53C made of nylon coming into contact with the front end portion of the charging needle 44A is provided. The brush 53C is supported on a supporter 66 attached to the lower holder 54A of the container 54. Furthermore, FIG. 6D illustrates an example in which a curved elastic brush 53D is provided in a supporter 67 attached to the lower holder 54A of the container 54.

Figure 7:
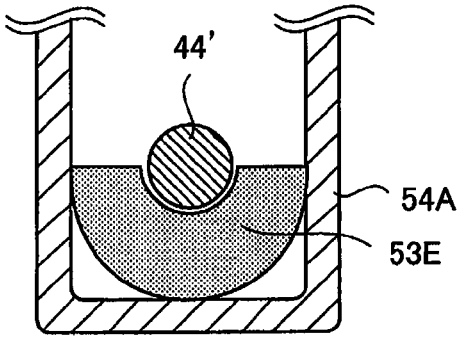
FIG. 7 illustrates a cross-sectional view of another example of a cleaning device in an embodiment.

Furthermore, the electrode 44 may use a corona wire instead of the needle-shaped electrode. An example of the cleaning member 53 when using the electrode of the corona wire is illustrated in FIG. 7. In FIG. 7, a cleaning member 53E having a shape surrounding a half periphery of an electrode 44' of the corona wire is used. The cleaning member 53E may use, for example, a material such as polyimide or polyamide.

In order to clean the electrode 44' of the corona wire, a cleaning member 53C of a brush shape as shown in FIG. 6C may be used.

According to a first embodiment, a user can securely remove silicon, toner, sheet residue or the like attached to the electrode 44 of the charging device 32 by pushing or pulling the movement rod 57.

Figure 8A:
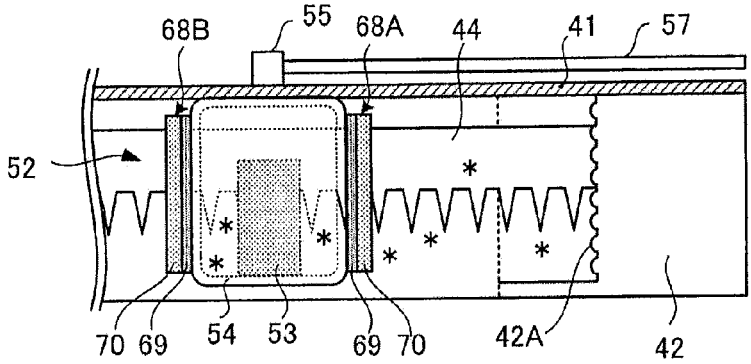
FIG. 8A illustrates an enlarged side view of a cleaning device of a charging device in a second embodiment.
Figure 8B:
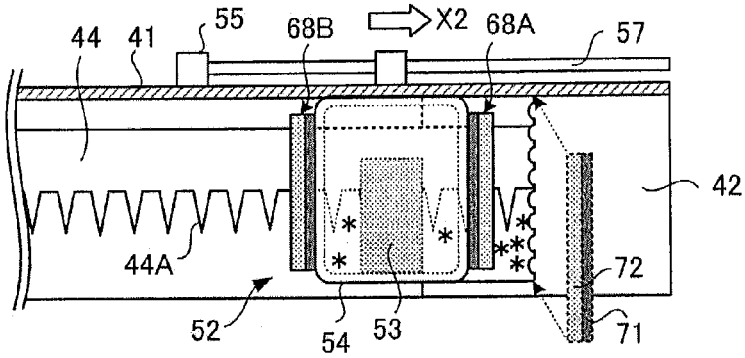
FIG. 8B illustrates a side view that shows the operation of a cleaning device in a second embodiment.

FIGS. 8A and 8B illustrate enlarged side views of a cleaning device 52 according to a second embodiment. FIG. 8A illustrates that auxiliary cleaning members 68A and 68B are mounted on a side surface of a movement direction of the container 54, that is, a surface facing the insulation terminals 42 and 43. The auxiliary cleaning members 68A and 68B are members in which, for example, acryl-based, urethane-based or rubber adhesive 70 is fixed to a sponge-like urethane foam 69.

The cleaning device 52 of FIG. 8A operates the movement shaft 57 to move the container 54, presses the container 54 to the insulation terminal 42 (or 43), and attaches the foreign matter (*) floating in the shield plate 41 to the auxiliary cleaning members 68A or 68B.

That is, the foreign matter (*) attached to the electrode 44 in the container 54 is scrapped off by the cleaning member 53 and is accommodated in the container 54. Furthermore, as shown in FIG. 8B, the foreign matter (*) floating in the shield plate 41, for example, toner dust, sheet powder, scrapped discharge product, fiber attached during product working or the like is attached to the auxiliary cleaning member 68A and is captured by pressing the container 54 against the insulation terminal 42.

Although FIG. 8B illustrates an example in which the container 54 is moved to the insulation terminal 42 side, the container 54 may be moved and pressed to the insulation terminal 43 side, whereby the foreign matter is attached to the auxiliary cleaning member 68B.

Generally, since the urethane-based adhesive has an excellent re-peeling property, such an adhesive is used for a protective sheet of a mobile phone, a dust removal roll or the like. Thus, as the adhesive 70 of the auxiliary cleaning members 68A and 68B, urethane-based adhesive may be used. Furthermore, surfaces, to which the auxiliary cleaning members 68A and 68B of the insulation terminals 42 and 43 are pressed, are minute convex and concave surfaces 42A, and may have shapes to which the adhesive 70 hardly sticks to and has a satisfactory peeling property. The convex and concave surfaces 42A may have shapes in which a plurality of multi-pyramids, cones, cylinders having round front ends are arranged in a row at equal distances, for example, having heights equal to or less than 2 mm.

Furthermore, as shown in FIG. 8B by dotted lines, elastic adhesion layers formed of the sponge 71 and the adhesive 72 may be stuck on a surface facing the container 54 of the insulation terminal 42 (or 43).

In the state in which contaminants such as the discharge product, dust, and toner are attached to the front end portion of the electrode 44, an image irregularity occurs in a white background portion of the printed image. However, immediately after the front end portion of the electrode 44 is cleaned by the cleaning device 52 of the present embodiment, images of the white background and a intermediate tone (half tone) are printed, an occurrence situation of the image irregularity (a discharge irregularity) was confirmed, and the result showed that the image irregularity (the discharge irregularity) does not occur even after 5,000 sheets of image sheet of printing rate 10% pass, and a satisfactory result was obtained.

Furthermore, although, as the movement mechanism of the container 54, a mechanism was described which is moved by the operation of the movement rod 57 by the user, the movement mechanism may be electrically moved by a motor and the like.

Figure 9:
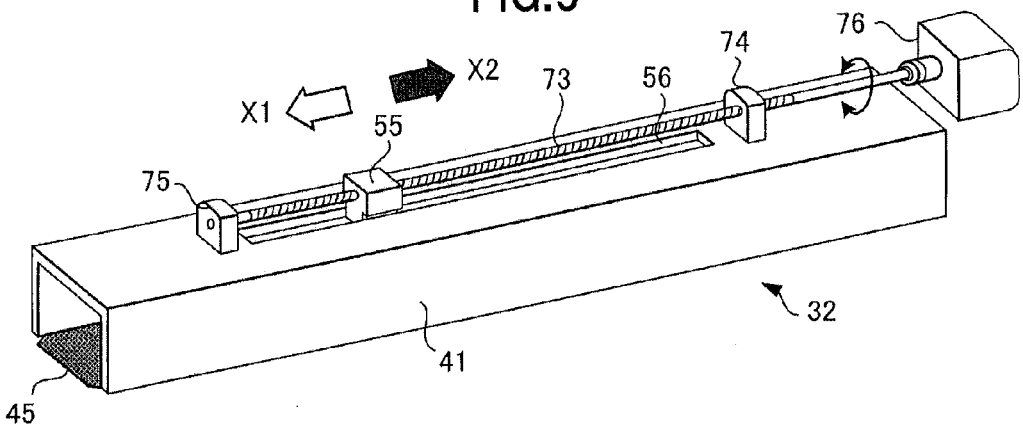
FIG. 9 illustrates a perspective view of a modified example of a movement mechanism of a cleaning device.

FIG. 9 illustrates a perspective view of a movement mechanism of the container 54 that uses the motor. For example, a rod 73 formed with a screw on an outer periphery thereof is included instead of the movement rod 57. The rod 73 is rotatably supported through protrusions 74 and 75 provided in the shield plate 41. Furthermore, the rod 73 is caused to penetrate the guide 55 provided in the container 54, whereby a spiral groove is formed in a hole through which the rod 73 of the guide 55 penetrates. Moreover, the guide 55 is moved by rotating the rod 73 by the motor 76. The motor 76 is rotatable forward and backward and can move the guide 55 in the arrow X1 direction or the reverse X2 direction.

Thus, by rotating the motor 76 in response to the operation of a user or rotating the motor 76 at the predetermined timing, the electrode 44 can be cleaned. Moreover, the mechanism, which moves the container 54 using the motor 76, is not limited to an example of FIG. 9. For example, the rotation of the motor may be transmitted to the belt, so that the guide 55 may be fixed to the belt. The mechanism has a structure in which the belt is moved by the rotation of the motor and the guide 55 (the container 54) is moved by the movement of the belt.

Furthermore, the cleaning member 53 fixed to the lower holder 54A of the container 54 is exchangeable, and when a lot of foreign matter is stacked in the container 54, the lower holder 54A may be pulled out to remove the foreign matter and may be exchanged for a new cleaning member 53. Furthermore, the auxiliary cleaning members 68A and 68B may also be exchangeable.

According to the aforementioned embodiments, be possible to reliably remove silicon, toner, sheet residue or the like attached to the discharge electrode of the charging device 32. Furthermore, the foreign matter floating in the charging device 32 can be captured and there is an effect of preventing image noise.

Moreover, various modifications can be made without being limited to the aforementioned embodiments. For example, the shape or the material of the cleaning member 53 can use other shapes or other materials without being limited to the aforementioned examples.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and the spirit of the inventions.

What is claimed is:

1. An image forming apparatus comprising:

an image carrier which is irradiated with a laser beam to form an electrostatic latent image;

a charging device including a shield plate having a U-shaped cross-section and extending parallel to the image carrier, a pair of insulation terminals each disposed in opposite end portions of the shield plate, and an electrode disposed between the pair of insulation terminals that provides an electric charge to the image carrier;

a cleaning device including a container having a first cleaning member abutting an end portion of a discharge side of the electrode and a second cleaning member disposed on a surface of the container facing one of the insulation terminals, the container movable between the insulation terminals along a longitudinal direction of the electrode causing foreign matter attached to the electrode to be removed by the first cleaning member, wherein the foreign matter removed by the first cleaning member is accommodated in the container, and foreign matter in the shield plate attaches to the second cleaning member when the container is pressed against one of the insulation terminals;

a developing device that supplies the image carrier with a developer;

a transfer device that transfers a toner image formed on the image carrier by the developing device onto a recording medium.

2. The apparatus of claim 1, wherein the first cleaning member can be attached to and detached from the inside of the container.

3. The apparatus of claim 1, wherein the first cleaning member elastically contacts the electrode.

4. The apparatus of claim 1, wherein the charging device includes a grid that is disposed in an open side of the shield plate.

5. The apparatus of claim 1, wherein the second cleaning member is an elastic adhesive.

6. A charging apparatus comprising:

a shield plate having a U-shaped cross-section and extending parallel to an image carrier;

a pair of insulation terminals each disposed in opposite end portions of the shield plate;

an electrode disposed between the pair of insulation terminals that provides an electric charge to the image carrier; and a cleaning device including a container having a first cleaning member abutting an end portion of a discharge side of the electrode and a second cleaning member disposed on a surface of the container facing one of the insulation terminals, the container movable between the insulation terminals along a longitudinal direction of the electrode causing foreign matter attached to the electrode to be removed by the first cleaning member, wherein the foreign matter removed by the first cleaning member is accommodated in the container, and foreign matter in the shield plate attaches to the second cleaning member when the container is pressed against one of the insulation terminals.

7. The apparatus of claim 6, wherein the first cleaning member can be attached to and detached from the inside of the container.

8. The apparatus of claim 6, wherein the first cleaning member elastically contacts the electrode.

9. The apparatus of claim 6, further comprising:

a grid that is disposed in an open side of the shield plate.

10. The apparatus of claim 6, further comprising a movement mechanism of the container including: a slit provided in a ceiling portion of the shield plate and extending in the longitudinal direction of the electrode, a guide provided on a surface of the container and at least partially extending through the slit, and a movement rod having an end portion fixed to a part of the guide that extends through the slit, the movement rod being movable by a user operation to move the container.

11. The apparatus of claim 6, wherein the container moves between the insulation terminals in the shield plate by rotation of a motor.

12. The apparatus of claim 6, wherein the second cleaning member is an elastic adhesive.

13. The apparatus of claim 6, wherein surfaces of the insulation terminals facing the second cleaning member are minute concave and convex surfaces.

14. The apparatus of claim 6, further comprising an elastic adhesive layer, which can be peeled, provided on the surfaces of the insulation terminals facing the second cleaning member.

15. A cleaning method of a charging device including a shield plate having a U-shaped cross-section and extending parallel to an image carrier, a pair of insulation terminals each disposed in opposite end portions of the shield plate, an electrode disposed between the pair of insulation terminals, the method comprising:

providing an electric charge to the image carrier by the electrode;

providing a first cleaning member abutting an end portion of a discharge side of the electrode in a container;

providing a second cleaning member on a surface of the container facing one of the insulation terminals;

moving the container between the insulation terminals along a longitudinal direction of the electrode;

removing foreign matter attached to the electrode by the first cleaning member and accommodating the foreign matter in the container; and attaching foreign matter in the shield plate to the second cleaning member when the container is pressed against one of the insulation terminals.

16. The method of claim 15, wherein the first cleaning member can be attached to and detached from the inside of the container.

17. The method of claim 15, wherein the charging device includes a grid disposed in an open side of the shield plate.

* * * * *